United States Patent [19]

Furukawa et al.

[11] Patent Number: 4,725,696

[45] Date of Patent: Feb. 16, 1988

[54] TOUCH-OPERATED SEE-THROUGH COORDINATE INPUT UNIT

[75] Inventors: Mikio Furukawa, Tokyo; Kazutoki Tahara; Yosuke Kunishi, both of Saitama, all of Japan

[73] Assignee: Shin-Etsu Polymer Co., Ltd., Tokyo, Japan

[21] Appl. No.: 869,099

[22] Filed: May 30, 1986

[30] Foreign Application Priority Data

Jun. 11, 1985 [JP] Japan ..... 60-126901
Jun. 11, 1985 [JP] Japan ..... 60-126902

[51] Int. Cl.[4] ..... G08C 21/00
[52] U.S. Cl. ..... 178/18
[58] Field of Search ..... 178/18, 19; 340/706

[56] References Cited

U.S. PATENT DOCUMENTS 4,620,062 10/1986 Mizzi et al. ..... 178/18
4,638,118 1/1987 Wang et al. ..... 178/18

*Primary Examiner*—Stafford D. Schreyer
*Attorney, Agent, or Firm*—Jules E. Goldberg

[57] ABSTRACT

In the inventive touch-operated see-through coordinate input unit, the contacting wires embedded in the upper and lower substrate sheets in a relative perpendicular disposition are divided into groups each of at least two of the adjacent wires and the wires belonging to the same group are bonded to the same electrode. When the upper sheet is depressed with a finger tip or stylus point at a crossing point of the wires on the upper and lower sheets, electrical contact can be obtained at two points or more between wires so that, different from conventional coordinate input units in which electrical contact is obtained at only a single point by a pushing stroke, the reliability of the input operation can be greatly improved also with decreased fatigue of the operator in continuous working of long time.

1 Claim, 3 Drawing Figures

TOUCH-OPERATED SEE-THROUGH COORDINATE INPUT UNIT

BACKGROUND OF THE INVENTION

The present invention relates to a touch-operated see-through input unit of electrode-contact type or, more particularly, to a touch-operated see-through coordinate input unit of practically desirable performance which can be operated easily and reliably without giving little fatigue to the operator even after a long time of continued operation.

Various types of coordinate input units are known and used for inputting data to electronic instruments including the electrode-contact type, pressure type and surface acoustic wave type ones. When such a input unit is used as mounted on or in front of the display screen of a CRT display unit for computer terminals, it is sometimes desirable that the input unit is see-through in order not to disturb the operator's sight on the display screen. From the standpoint of satisfying such a requirement, conventional coordinate input units are not quite satisfactory in several respects. For example, the electrode-contact type unit is a membrane type key board switching unit formed of transparent plastic films provided with an extremely thin and light-transmitting electroconductive surface film of a metal, e.g. silver and lead, or an electroconductive metal oxide, e.g. indium oxide, by vapor-phase deposition or sputtering on certain areas so that, although such a unit is simple in the structure and widely used industrially, several disadvantages are unavoidable that the transparency is not high enough, the contact resistance is sometimes high and the electroconductive surface film is mechanically fragile leading to a limited yield of acceptable products in manufacture and low durability or serviceable life.

Further, touch-operated see-through coordinate input units are expected to find wide applications in many fields in which intensive investigations are under way for development using such a unit, for example in the systems of plant control of which high reliability is essential, instruments for office automation of which good operability is required to facilitate long-time continued operation, instruments of which size reduction is required such as portable type terminal instruments, instruments operated by many and unspecified persons such as terminal instruments of a videotex system and the like.

A type of touch-operated see-through coordinate input units is disclosed in Japanese Utility Model Publication 60-9869 according to which a flexible insulating sheet having transparency and a transparent insulating substrate plate are held in parallel and a first array of metal wires each in parallel to the others at a uniform pitch and a second array of metal wires each in parallel to the others at a uniform pitch are disposed between the insulating sheet and the insulating substrate plate in such a lattice-wise manner that the wires in the first array and the wires in the second array are perpendicular to each other while an insulating string having a diameter larger than the metal wires in the first and second arrays is disposed in every space between the adjacent metal wires in the first or second array to serve as a spacer for keeping the metal wires in the first and the second arrays apart from each other to ensure electric insulation therebetween when the input unit is not pushed by finger touch. The coordinate input unit of this type, however, is disadvantageous because of the low reliability caused by the intrusion of atmospheric dusts between the sheet and substrate plate and improvement in the reliability of contacting cannot be expected by the impression of a large electric current.

SUMMARY OF THE INVENTION

Thus, an object of the present invention is to provide a touch-operated see-through coordinate input unit capable of being operated with stability even in long-time continued works. In particular, the object of the invention is to provide such an input unit exhibiting remarkably low contact resistance and capable of being operated with greatly improved operability and reliability.

The touch-operated see-through coordinate input unit of the present invention comprises:

(a) a first electrically insulating transparent sheet having flexibility provided on one surface with an array of metal wires or, generally, electroconductive lines, each in parallel to the others;

(b) a second electrically insulating transparent sheet provided on one surface with an array of metal wires or, generally, electroconductive lines, each in parallel to the others and disposed in parallel to the first sheet in such a manner that the arrays of the metal wires on the first and second arrays face one to the other, the running direction of the wires on the first sheet being perpendicular to the running direction of the wires on the second sheet; and (c) a plurality of electrically insulating spacers disposed between the first and the second sheets to keep the arrays of metal wires thereon apart each from the other when the sheet is not in a depressed condition by pushing with a pushing body but not to disturb contacting of the metal wires on the first and the second sheets each with the other when the sheet is depressed by pushing with a pushing body, the pitch of arrangement of the metal wires on at least either one of the first and the second sheets being such that at least two contacting points are formed between the metal wires on the first sheet and the metal wires on the second sheet when the first sheet is depressed by pushing with a pushing body.

DETAILED DESCRIPTION OF THE PREFERRED EMBODIMENTS

Figure 1:
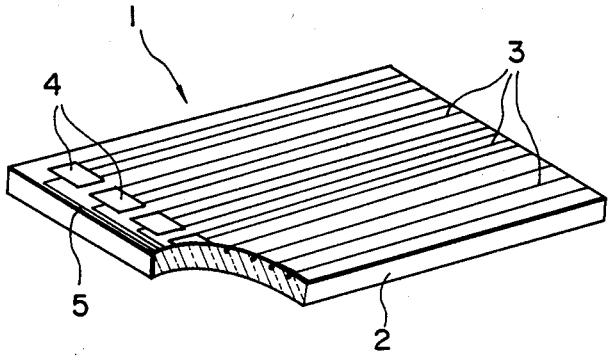
FIG. 1 is a perspective view of the insulating sheet and the array of wires with partial cutting and FIG. 2 is a partial cross sectional view of the inventive input unit.

As is understood from the above given summary, the inventive input unit is composed of the first insulating sheet, which may be called the upper member, provided with an array of metal wires bonded to a surface, the second insulating sheet, which may be called the lower member, also provided with metal wires bonded to a surface and a plurality of insulating spacers.

The material to form the substrate of the upper and lower members is not particularly limitative and various kinds of synthetic resins and rubbers can be used therefor including general-purpose thermoplastic resins such as ABS resins, nylon resins, polypropylenes, polyvinyl chlorides and the like, thermosetting resins such as polycarbonate resins, saturated and unsaturated polyester resins, epoxy resins and the like and rubbers such as silicone rubbers and the like. These polymeric materials are shaped into a form of film, sheet or plate and the thickness thereof should be sufficient to ensure flexibility which is essential to give good operability of the switching works on the input unit in the range, for example, from 0.05 to 0.40 mm when the sheet is used for the upper member to be depressed by pushing with a pushing body such as a finger tip or a stylus point. The second insulating sheet or the lower member should not necessarily be flexible but can be rigid so that the thickness thereof can be 0.05 mm or larger. When the lower member is flexible and rigidity is required for the input unit as a whole, a rigid transparent liner plate should be provided on the surface of the second insulating sheet to which no metal wires are bonded.

When anti-glaringness is desired of the inventive input unit, the transparent substrate sheet should be anti-glaring or should be laminated with an anti-glaring sheet so as to reduce the eye fatigue of operators who watch a light-emitting display screen such as CRT and the like through the input unit even after a continued long-time working.

Each of the upper and lower members is provided with an array of metal wires bonded to the transparent insulating substrate sheet. The kind of the metal of the wires is not particularly limitative provided that the metal wires have a low electric resistance and adequate mechanical strengths including flexibility. Exemplary of suitable metals are copper, aluminum, phosphor bronze, gold, nickel, tungsten and alloys thereof although wires of other metals or alloys having a relatively high electric resistance can also be used depending on the intended use of the input unit such as wires of stainless steel, Nichrome and the like as well as strings of insulating materials plated with a metal or alloy or coated with a conductive composition. Further, it is optional that a pattern of parallel lines is formed on the insulating sheet by printing with a conductive ink or paint in place of metal wires.

Bonding of the metal wires to the insulating substrate sheet can be performed by use of an adhesive which should also desirably be transparent. Exemplary of suitable adhesives are acrylic, urethane-based, isocyanate-based and epoxy-based adhesives and hot-melt type adhesives. The surface of the transparent substrate sheet is coated with the adhesive and the metal wires are put thereon in a parallel arrangement to form an array of wires. When the substrate sheet is made of a thermoplastic resin, metal wires can be bonded to the sheet without using an adhesive by gently pressing the array of wires put on the sheet at a temperature slightly higher than the softening point of the resin so that each of the wires is partly embedded in and partly exposed on the plastic sheet over the whole length. When the substrate sheet is made of a hot air-vulcanizable transparent silicone rubber, the metal wires are put on an uncured rubber sheet in an array and then gently pressed at room temperature to partly sink into the rubber sheet followed by hot-air vulcanization.

The metal wire may be either a solid wire or a stranded wire. The diameter of the wire is not particularly limitative but the diameter should preferably be in the range from 0.01 to 0.20 mm from the practical standpoint since an array of metal wires having a too large diameter may decrease the see-through viewableness through the inventive input unit while metal wires having a smaller diameter are mechanically less reliable.

The transparent insulating sheets each provided with a parallel array of metal wires are disposed in parallel to each other in such a manner that the arrays of the metal wires bonded to and at least partly exposed on the two sheets face to each other keeping an adequate space therebetween by use of a plurality of insulating spacers. The running directions of the metal wires on the two sheets should be perpendicular so as to give a lattice-like appearance in the see-through view. The distance between the sheets should be sufficient not to cause inadvertent contacting between the metal wires on the different sheets but to ensure reliable contacting therebetween when the upper member is depressed by pushing with a pushing body.

The pitch at which the metal wires are arranged in parallel to form an array should be adequately selected depending on the diameter of the metal wires and the size of the pushing body which pushes and depresses the upper member to form an electric contact between the wires on the upper and lower members. The pushing body here implied is the end portion of a rod-like body such as a finger tip, pen point and stylus point. When the pushing body is a finger tip, the spot or area of the upper member effectively depressed by pushing has a diameter of about 7 to 10 mm while the diameter may be 0.3 to 1 mm when the pushing body is a stylus point. Assuming that each of the metal wires has a diameter of 0.02 to 0.03 mm, the pitch of the arrangement of metal wires should preferably be 2 to 3 mm when the pushing body is a finger tip and 0.1 to 0.3 mm when the pushing body is a stylus point.

In the inventive input unit, it is essential that, assuming that the upper member is depressed by pushing with a pushing body, at least two contacting points should be formed by a single pushing stroke between the metal wires on the upper and lower members. In other words, a wire on the upper member should be brought into contact with two or more wires on the lower member or vice versa or each of two or more wires on the upper member should be brought into contact with two or more of the wires on the lower member by a single pushing stroke. Namely, the metal wires on each of the upper and lower members should be divided into several groups each composed of a plural number of wires and the metal wires belonging to the same group should be connected to a single electrode as a group. Such a condition can be achieved by suitably selecting the pitches for the arrangement of the metal wires and the spacers. It is of course that at least two metal wires should be provided to each of the spaces between two adjacent spacers. Since it has been experimentally found that the pushing stroke by an ordinary operator falls within an area of about 13 mm diameter at a 95% probability when the uses his finger tip as the pushing body and within an area of 3 to 4 mm diameter when the pushing body is a stylus point also at a 95% probability, it is preferably that the pitch of the groups of the metal wires should be 10 to 25 mm for a finger tip or 5 to 10 mm for a stylus point in order to minimize errors in pushing.

The metal wires in an array are usually arranged at a constant pitch or, in other words, the distances between any two adjacent wires are uniform. It is, however, optional that the pitch of wire arrangement is more dense in the zones on one sheet where the metal wires can reliably contribute to establish contacting with the metal wires on the other sheet when depressed than in the zones where no reliable contacting can be expected between the metal wires on the two sheets as in the very vicinity of a spacer. This means is effective to increase the apparent light transmission or see-through viewableness through the inventive input unit without decreasing the reliableness of the input works therewith in addition to the saving effect of the amount of metal wires. When the inventive see-through coordinate input unit is used by mounting in front of a display screen such as CRTs, LCDs, ELs, plasmas and the like, it is sometimes advantageous that the metal wires are arranged at a pitch identical to that of the display dots in order to decrease the offensiveness of the metal wires to the operator's eyes or to increase the apparent light transmission or see-through viewableness. It is of course that the pitches of the wire arrangement on the upper and lower members may not be the same but can be different from each other in order to maximize the operating efficiency.

As is mentioned above, the metal wires on each of the upper and lower members are divided into groups and the wires belonging to the same group are connected to an electrode which in turn is connected to a leader line leading to an outer circuit. Thus, each of the upper and lower members is provided with electrodes and leader lines each of the same number as the groups of the metal wires. An advantageous arrangement of the electrodes is that the electrodes are arranged in a row in the direction perpendicular to the running direction of the metal wires and the row of the electrodes is positioned near to one of the peripheries of the sheet leaving a margin on which the leader lines should run. In such an arrangement of the electrodes and leader lines, it is of course that the leader lines should be electrically insulated from the metal wires below by first providing an insulating layer on the peripheral zone of the sheet and the leader lines run thereon. It is a convenient and efficient way that the insulating layer is formed by printing with an insulating resist material while the electrodes and the leader lines are formed by printing with a conductive paint or ink although it is optional that the electrodes are formed by bonding a metal sheet or foil and the insulating layer is formed of an electrically insulating plastic film, paper, cloth or laminate thereof.

In the following, the coordinate input unit of the invention is described in more detail with reference to the accompanying drawing.

FIG. 1 illustrates a perspective view with a partial cutting of the lower member 1 formed of a transparent sheet or plate 2 on which a plurality of metal wires 3 are arranged in parallel to each other to form an array. Each of these metal wires 3 is embedded, preferably, at least a half-diameter depth in the substrate sheet 2 exposing only a part of the surface. As is illustrated in the figure, the metal wires 3 are divided into groups in threes and the terminal portions of the metal wires belonging to the same group are commonly connected to or contacted by an electrode 4 from which a leader line 5 for connecting the input unit 1 to an outer circuit runs out on the sheet 2 where no metal wires are provided. The electrodes 4 each connected to the respective group of the metal wires 3 should be aligned on a row along the periphery of the sheet member 1. The space between two adjacent electrodes 4 should preferably be as small as possible in order to minimize the number of the metal wires 3 not in contact with any of the electrodes 4 or ineffective metal wires 4.

Figure 2:
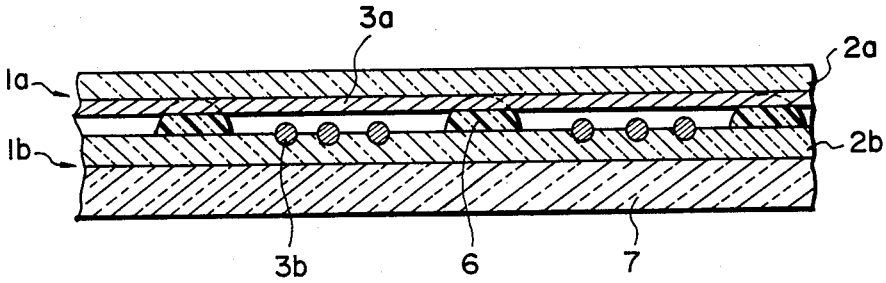

FIG. 2 illustrates a partial cross sectional view of the inventive coordinate input unit formed of an assembly of an upper member 1*a*, a lower member 1*b* and a plurality of spacers 6. Each of the upper and lower members 1*a*, 1*b* has substantially the same structure as the sheet member 1 illustrated in FIG. 1. The upper member 1*a* is laid on the lower member 1*b* with a plurality of insulating spacers 6 intervening therebetween in such a manner that the arrays of the metal wires 3*a*, 3*b* bonded to the substrate sheets 2*a*, 2*b*, respectively, face to each other and the running directions of the metal wires 3*a* and 3*b* are perpendicular to each other to give a lattice-like see-through appearance. FIG. 2 is a cross sectional view by cutting the unit in a plane perpendicular to the running direction of the metal wires 3*b* on the lower member 1*b*. A relatively rigid transparent plate 7 is bonded to the lower surface of the lower member 1*b* to give rigidity to the input unit as a whole although such a lining plate 7 need not be used when the substrate 2*b* of the lower member 1*b* has sufficient rigidity.

Each of the spacers 6 is positioned between the metal wires 3*b* on the lower member 1*b*. In accordance with the grouping of the metal wires 3*b* or 3*a* in threes, the spacers 6 are provided at every space between the adjacent groups of the metal wires 3*b* or 3*a* each composed of three wires. In other words, the three metal wires 3*b* or 3*a* positioned between two adjacent spacers 6 belong to the same group and connected commonly to an electrode 4 but the metal wires 3*b* or 3*a* belonging to different groups are bonded to different electrodes 4. Though not particularly limitative, each of the insulating spacers 6 may be in the form of a protruded dot or in the form of an oblong protrusion. When the spacers 6 are each in the form of an oblong protrusion, the direction of the longer axes of the protrusions should be in parallel to the metal wires on either of the upper member 1*a* or the lower member 1*b*. The spacers 6 should also be formed preferably of a transparent material such as a silicone rubber and should preferably be integrated with the substrate sheet 2*b* or 2*a*.

Figure 3:
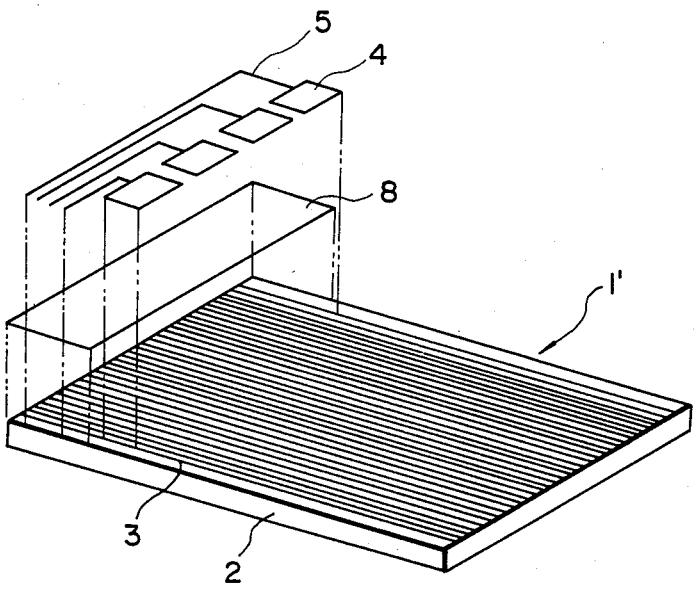
FIG. 3 is a perspective view showing the assembly of the insulating sheet with metal wires and the electrodes therefor.

FIG. 3 illustrates another embodiment of the member 1' with the electrodes 4 as disassembled. In the sheet member 1 illustrated in FIG. 1, each of the metal wires 3 does not reach the very periphery of the substrate sheet 2 leaving a marginal zone where no metal wires are bonded to the surface and such a marginal zone serves to support the leader lines 5 running thereon. Different from such a model illustrated in FIG. 1, each of the metal wires 3 of the sheet member 1' illustrated in FIG. 3 runs end-to-end reaching the very peripheries of the substrate sheet 2. This model is very advantageous in respect of the productivity over that illustrated in FIG. 1 since such a sheet member cab be prepared by first bonding continuous-length metal wires to a surface of a continuous length belt-like transparent sheet material followed by cutting the same in desired product lengths. In this case, the electric insulation between the metal wires 3 and the leader lines 5 each running out of one of the electrodes 4 is obtained by first providing an insulating layer 8 on the marginal zone of the sheet member 2 and then providing the electrodes 4 and the leader lines 5. The leader lines 5 should run entirely on the insulating layer 8 while each of the electrodes 4 should bridge between a leader line 5 and one of the groups of the metal wires 3 on the sheet member 2 as being partly borne by the insulating layer 8. The insulating layer 8 can be conveniently formed by printing with an electrically insulating pasty ink or paint or so-called resist material on the substrate sheet 2 to which the metal wires 3 are bonded although it is optional to provide such an insulating layer 8 with a plastic film, paper, cloth or laminate thereof. Thereafter, the electrodes 4 and the leader lines 5 are formed at one time also by printing with an electroconductive ink or paint.

What is claimed is:

1. A touch-operated see-through coordinate input unit which comprises:

(a) a first electrically insulating transparent substrate sheet having flexibility provided on one surface with an array of electroconductive lines each in parallel to the others and bonded to the surface;

(b) a second electrically insulating transparent substrate sheet provided on one surface with an array of electroconductive lines each in parallel to the others and bonded to the surface, the first and second substrate sheets being disposed in parallel to each other in such a manner that the arrays of the electroconductive lines on the first and second substrate sheets face one to the other, the running direction of the electroconductive lines on the first sheet being perpendicular to the running direction of the electroconductive lines on the second sheet;

(c) a plurality of electrically insulating spacers integrally bonded to either of the first and the second substrate sheets and disposed between the first and the second sheets to keep the arrays of the electroconductive lines thereon apart each from the other when the first substrate sheet is not in a depressed condition by pushing with a pushing body but not to disturb contacting of the electroconductive lines on the first and the second sheets each with the other when the first substrate sheet is depressed by pushing with a pushing body, the electroconductive lines on at least either one of the first and the second sheets being divided into groups of at least two adjacently positioned electroconductive lines;

(d) electrically insulating layers each laid on a marginal zone of the first or second substrate sheet to cover the end portions of the electroconductive lines;

(e) a plural number of electrodes laid on the first or second substrate sheet and each electrically contacted with the electroconductive lines belonging to the same group; and (f) a plural number of leader lines each of which is electrically connected to one of the electrodes and runs on the electrically insulating layer on the marginal zone of the substrate sheet.

* * * * *